US006626750B2

(12) United States Patent
Momemy

(10) Patent No.: US 6,626,750 B2
(45) Date of Patent: Sep. 30, 2003

(54) TOKEN COUNTING USING SCANNER

(76) Inventor: Blash Momemy, 22351 Amber Rose, Mission Viejo, CA (US) 92692

( * ) Notice: Subject to any disclaimer, the term of this patent is extended or adjusted under 35 U.S.C. 154(b) by 0 days.

(21) Appl. No.: 10/153,578

(22) Filed: May 21, 2002

(65) Prior Publication Data

US 2003/0022614 A1 Jan. 30, 2003

Related U.S. Application Data

(63) Continuation of application No. 09/548,521, filed on Apr. 13, 2000, now Pat. No. 6,425,817.

(51) Int. Cl.[7] ..... G07D 9/00
(52) U.S. Cl. ..... 453/17; 453/58
(58) Field of Search ..... 453/17, 58, 2, 453/60; 377/7, 14

(56) References Cited

U.S. PATENT DOCUMENTS

| | | | | |
|---|---|---|---|---|
| 4,774,841 A | * | 10/1988 | Chadwick | 453/17 X |
| 5,530,730 A | * | 6/1996 | Takemoto et al. | 453/58 X |
| 5,755,618 A | * | 5/1998 | Mothwurf | 453/17 |
| 6,425,817 B1 | * | 7/2002 | Momemy | 453/17 |

* cited by examiner

*Primary Examiner*—James R. Bidwell
(74) *Attorney, Agent, or Firm*—Blakely, Sokoloff, Taylor & Zafman

(57) ABSTRACT

In one embodiment of the present invention, a technique is provided to count tokens on a gaming table. A sensor senses a characteristic of each token in a plurality of tokens in a token holder on the gaming table. The characteristic represents a valuation of each token. A token processing unit coupled to the sensor to process the sensed characteristic to determine a count of the plurality of tokens.

36 Claims, 10 Drawing Sheets

TOKEN COUNTING USING SCANNER

CROSS-REFERENCES TO RELATED APPLICATIONS

This is a continuation application of U.S. patent application Ser. No. 09/548,521 filed Apr. 13, 2000 now U.S. Pat. No. 6,425,817.

BACKGROUND

1. Field of the Invention

This invention relates to table gaming. In particular, the invention relates token counting.

2. Description of Related Art

Table games in casinos involve use of tokens or chips to replace real money for players to place bets. These tokens typically have a rounded shape, like a coin, with various colors designating the value of the token. In a typical table game (e.g., blackjack), the tokens are kept in tray on the table close to the dealer. A player places a bet by putting a number of tokens on his or her player area. When the cards are dealt and result of the game is completed, the dealer pays out or collects the tokens depending on whether the dealer loses or wins. If the dealer loses, he pays the winning player(s) by removing the tokens from the dealer's tray and puts the tokens next to the player's betting area. If the dealer wins, he collects the tokens from the losing player(s) and puts back in the dealer's tray. In a typical playing session, the amount of tokens in the dealer's tray may go up or down depending on the dealer's winning/losing situations.

A casino or a gaming house needs to keep track of the amount of tokens continuously to avoid theft or loss. The current method is to assign a supervisor at each playing area. The supervisor, commonly referred to as the "pit boss" constantly monitors the dealers and the players. In addition, hidden video cameras covering the playing area provide visual monitoring by security personnel in the casino. To keep track of the amount of the tokens at each gaming table, the supervisor periodically requests a count of the current tokens. The tokens are then counted manually either by the dealer or another casino personnel at the presence of the dealer and the supervisor. Then, the count is recorded manually in a book so that at the end of the day or at some designated time, the total count is tallied so that the daily loss or win can be determined.

This manual counting has a number of drawbacks. First, the counting may not be accurate, resulting in incorrect recording. Second, the playing is interrupted, causing inconvenience and sometimes frustration to the players. Third, theft may still be possible if there is conspiracy among the dealer and the supervisor. Fourth, the counting is time consuming and therefore adds additional burden to the dealer and the supervisor.

Therefore, there is a need to have a technique that can overcome the above problems.

SUMMARY

In one embodiment of the present invention, a technique is provided to count tokens on a gaming table. A sensor senses a characteristic of each token in a plurality of tokens in a token holder on the gaming table. The characteristic represents a valuation of each token. A token processing unit coupled to the sensor to process the sensed characteristic to determine a count of the plurality of tokens.

BRIEF DESCRIPTION OF THE DRAWINGS

The features and advantages of the present invention will become apparent from the following detailed description of the present invention in which.

DESCRIPTION

In one embodiment of the present invention, a technique is provided to count tokens on a gaming table. A sensor senses a characteristic of each token in a plurality of tokens in a token holder on the gaming table. The characteristic represents a valuation of each token. A token processing unit coupled to the sensor to process the sensed characteristic to determine a count of the plurality of tokens.

In the following description, for purposes of explanation, numerous details are set forth in order to provide a thorough understanding of the present invention. However, it will be apparent to one skilled in the art that these specific details are not required in order to practice the present invention. In other instances, well-known electrical structures and circuits are shown in block diagram form in order not to obscure the present invention.

Figure 1:
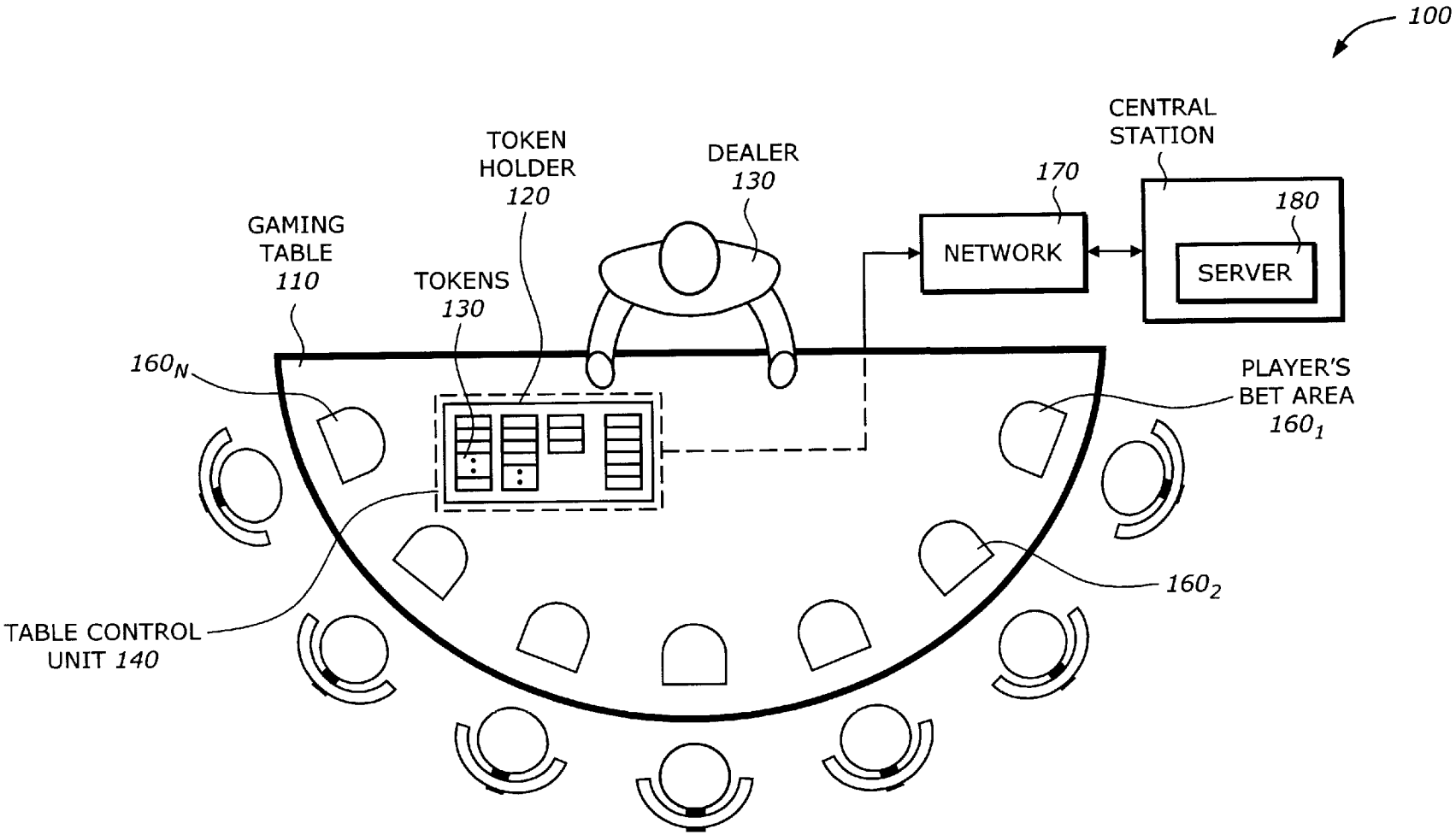
FIG. 1 is a diagram illustrating a system in which one embodiment of the invention can be practiced.

FIG. 1 is a diagram illustrating a system 100 in which one embodiment of the invention can be practiced. The system 100 includes a gaming table 110, a token holder 120, a plurality of tokens 130, a table control unit 140, a dealer 150, and a plurality of player's bet areas $\mathbf{160}_1$ to $\mathbf{160}_N$.

The gaming table 110 is a table on which a game session is held. Typically, the games are gambling games such as card games (e.g., blackjack) involving the dealer 150 and a number of players. The token holder 120 holds the tokens 130 or chips used in the game session. The token holder 120 may be a tray installed firmly on the gaming table 110. The token holder 120 typically has a transparent base so that optical illumination and/or image sensing can be performed. The tokens 130 include a number of tokens having at least one characteristic to correspond to the monetary valuation. The characteristic may be the size, the shape, the color of the tokens or any information that can be embedded in the token (e.g., magnetic data). Typically, the token 130 has a round shape with some thickness like a coin. The color of the token 130 may be used to designate the denomination of the monetary value of the token. For example, a green token may correspond to $5, a black token may correspond to $100.

The table control unit 140 is mounted in the proximity of the token holder 120. In one embodiment, the table control unit 140 is mounted underneath the surface of the table, right below the token holder 120.

The dealer 150 is responsible for collecting tokens from players when the dealer wins or paying out tokens to the players when the dealer loses. The dealer 150 keeps the tokens 130 inside the token holder 120. Typically, the tokens are arranged as stacks of tokens such that like tokens are arranged in the same column in the token holder 120.

Figure 2:
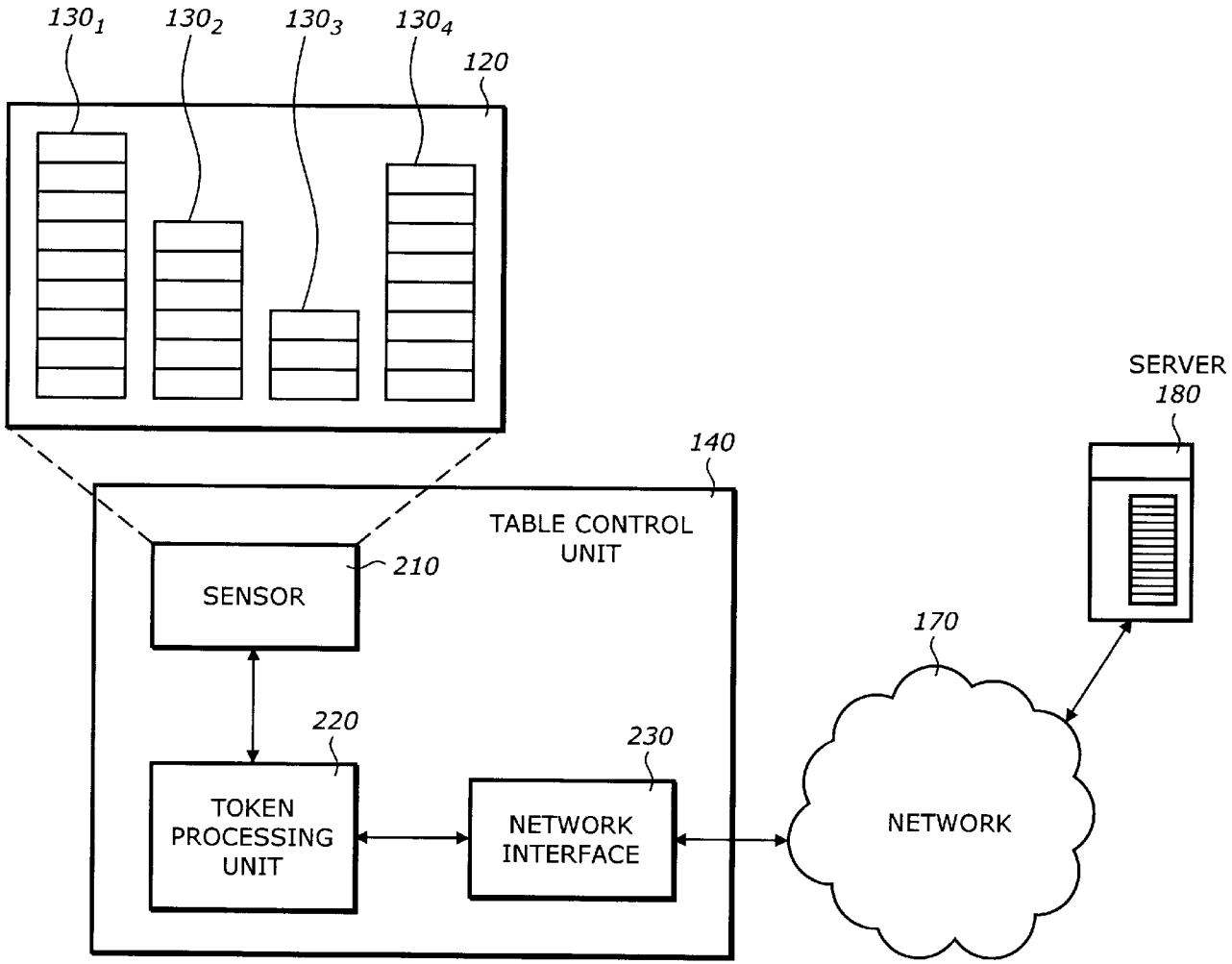
FIG. 2 is a diagram illustrating a table control unit according to one embodiment of the invention.

FIG. 2 is a diagram illustrating a table control unit 140 according to one embodiment of the invention. The table control unit 140 includes a sensor 210, a token processing unit 220, and a network interface 230.

The sensor 210 senses a characteristic of the plurality of tokens 130. The characteristic corresponds to a valuation of the token. For example, the characteristic may be size, shape, color or other embedded information such as magnetic data. In one embodiment, the sensor 210 includes an image scanner which scans the token holder 120 to obtain an image of the plurality of tokens 130. In another embodiment, the sensor 210 includes a video camera to obtain image of the plurality of tokens 130. Yet, in another embodiment, the sensor 210 includes a magnetic reader or sensor to read the magnetic data embedded in the token.

The token processing unit 220 processes the sensed characteristic of the tokens 130 to determine a count of the plurality of tokens 130. The token processing unit 220 receives the output of the sensor 210, e.g., an image obtained by the sensor 210.

The network interface 230 is connected to the token processing unit 220 to allow the token processing unit to exchange information with the server 180 via a network 170. The network 170 is any of the networks available to facilitate remote information exchange between the table control unit 140 and the server 180. The network interface 230 may provide appropriate network connection, such as local area network (LAN) or the Internet, to the network 170. The server 180 is a station that provides monitoring and control of the table control unit 140 and other table control units or other network devices in the casino. The server 180 allows casino personnel to send commands or inquires to individual table control units, receive status or responses from the table control units, and perform other communication and control functions.

Figure 3:
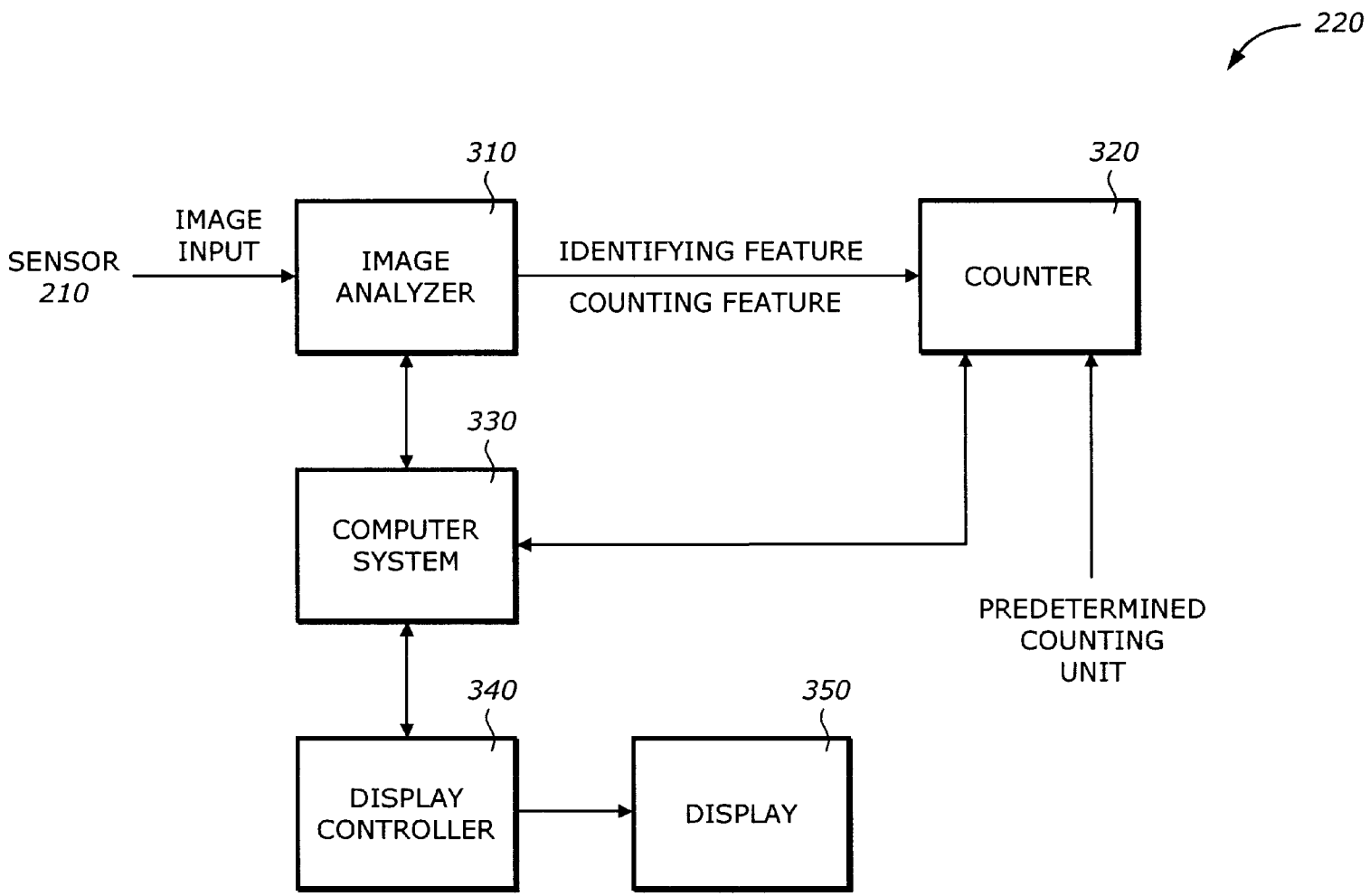
FIG. 3 is a diagram illustrating a token processing unit shown in FIG. 2 according to one embodiment of the invention.

FIG. 3 is a diagram illustrating a token processing unit 220 shown in FIG. 2 according to one embodiment of the invention. The token processing unit 220 includes an image analyzer 310, a counter 320, a computer system 330, a display controller 340, and a display 350.

The image analyzer 310 receives the image of the tokens 130 as obtained by the sensor 210. The image analyzer 310 analyzes the image to extract relevant features of the tokens 130 for further processing. Examples of relevant features include an identifying feature and a counting feature. The identifying feature is a feature that is used to identify the different types of tokens 130. For example, the identifying feature may be size, color, image density or magnetic data. The counting feature is the feature that is used to determine the count of the tokens having similar identifying feature. For example, the counting feature may be the thickness of the tokens as measured when they form in a stack, or column in the token holder 120.

The counter 320 receives the identifying feature and the counting feature and generate the count of the tokens 130. The counter 320 groups all the tokens that have the same or similar identifying feature such as color. The counter 320 obtains the counting feature of all the tokens belong in the same group having the same identifying feature. For example, if the tokens 130 are divided into 4 types of tokens corresponding to 4 types of monetary denomination, then the counter 320 obtains 4 identifying features, say, 4 different colors (e.g., green, yellow, black, and red) together with the corresponding counting feature such as the total thickness of each of the 4 groups.

To determine the count of the tokens having the same identifying feature, and thus corresponding to the same type of denomination, there are a number of methods. One method is to divide the counting feature by a predetermined counting unit, such as the thickness of one token of the corresponding type. The quotient of this division corresponds to the count of the tokens. The total length, or counting feature, of the group of tokens can be expressed in any measurement unit as long as the predetermined counting unit uses the same measurement unit. For example, a measurement unit may be the pixel size as obtained by the scanner or video camera, or the actual size (e.g., in inches or millimeters) as calculated by the image analyzer 310.

Another method is to create a matrix that matches to layout of the token holder 120. This matrix has a number of columns N corresponding to stacks of tokens, and a number of rows P corresponding to the tokens/chips. The matrix has width and height determined as follows:

$$\text{Matrix width}=N^*\text{token size}+N^*\text{column spacing}$$

$$\text{Matrix height}=P^*\text{token size}$$

The matrix has N*P cells where the cell width is equal to the token size (e.g., diameter), and the cell height is equal to the token thickness.

The image as scanned or captured by the sensor 210 (in FIG. 2) is then next scaled accordingly to match the size of the matrix. After scaling, the image of the token holder 120 is then overlaid onto the matrix. Some landmark points can be used to facilitate the orientation or registration of the image points so that the overlaying is positioned correctly. The result of the overlaying is that each cell is either occupied by a token in the image or blank.

Next, the color or gray level characteristics of each cell is examined to determine if the cell is occupied by a token. A look up table in a database containing the colors or gray level characteristics of the token is used to determine the type of the token. The counting is performed to count the number of cells that are occupied, i.e., having tokens. The classification of the token type is done by using the look-up table.

The image analyzer 310, the counter 320, or the matrix technique for counting can be implemented by software programs executed by the computer system 330. They may also be implemented by hardware with specialized processors or circuits.

The computer system 330 provides the control for the image analyzer 310 and the counter 320. The computer system 330 includes a microprocessor or microcontroller that is capable of executing programs. In one embodiment, the image analyzer 310 and/or the counter 320 are software modules or programs that are executed by the computer system 330. In particular, the computer system 330 communicates with the counter 320 to obtain the count of the tokens. The computer system 330 also records the count for later retrieval and update. The computer system 330 may also communicate with the network 170 via the network interface 230 (FIG. 2) to transfer the count information to the central station or server 180.

The display controller 340 provides display control functions to the display 350 such as display refresh, graphics generation, animation, etc. The display 350 is any display device such as cathode ray tube (CRT), flat panel display, light emitting diodes (LED), liquid crystal display (LCD), plasma display, etc. The display 350 may be installed next to the token holder 120 (FIG. 1) so that the dealer can see the count or any messages sent by the central station or server 180. The display 350 may also display input provided by the dealer in response to a command from the server 180. The computer system 330 receives the count from the counter 320 and sends to the display controller 340 so that the count or counts of the tokens can be displayed.

Figure 4:
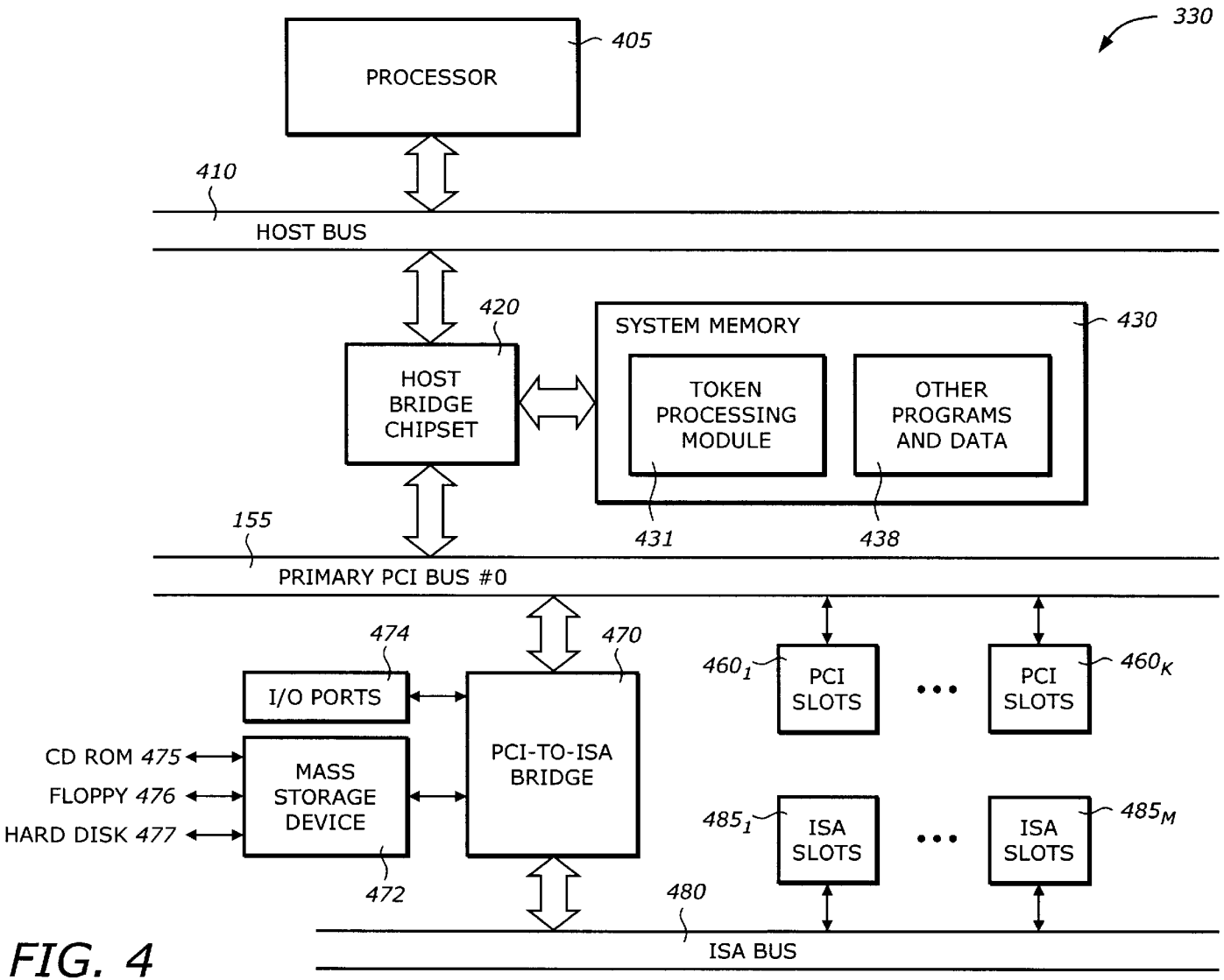
FIG. 4 is a diagram illustrating a computer system 330 in which one embodiment of the invention can be practiced.

FIG. 4 is a diagram illustrating a computer system 330 in which one embodiment of the invention can be practiced. The computer system 330 includes a processor 405, a host bus 410, a host bridge chipset 420, a system memory 430, a primary Peripheral Component Interconnect (PCI) bus #0 455, K PCI slots $\mathbf{460}_1$ to $\mathbf{460}_K$, a PCI-to-ISA bridge 470, mass storage devices 472, Input/Output (I/O) ports 474, an ISA bus 480, and ISA slots $\mathbf{485}_1$ to $\mathbf{485}_M$.

The processor 405 represents a central processing unit of any type of architecture, such as complex instruction set computers (CISC), reduced instruction set computers (RISC), very long instruction word (VLIW), or hybrid architecture. The host bus 410 provides interface between the processor 405 and the host bridge chipset 420 and other processors. The host bus 410 may support a multiprocessor or single processor system.

The host bridge chipset 420 includes a number of interface circuits to allow the host processor 405 access to the system memory 430 and the primary PCI bus #0 455. The system memory 430 represents one or more mechanisms for storing information. For example, the system memory 430 may include non-volatile or volatile memories. Examples of these memories include flash memory, read only memory (ROM), or random access memory (RAM). The system memory 430 contains a token processing module 431, and other programs and data 438. Of course, the system memory 430 preferably contains additional software (not shown), which is not necessary to understanding the invention.

The PCI slots $\mathbf{460}_1$ to $\mathbf{460}_K$ provide interfaces to PCI devices. Examples of PCI devices include the network interface and the media interface. The network interface connects to communication channel such as the Internet. The Internet provides access to on-line service providers, Web browsers, and other network channels. The media interface provides access to audio, graphics, and video devices. For example, the media interface may include the display controller 340 shown in FIG. 3.

The PCI-to-ISA bridge 470 provides access to the ISA bus 480, mass storage devices 472, and I/O ports 474. The mass storage devices 472 include CD ROM, floppy diskettes, and hard drives. The ISA bus 480 has a number of ISA slots $\mathbf{485}_1$ to $\mathbf{485}_M$ to interface to ISA devices. Examples of ISA devices include data entry devices (e.g., keyboard, mouse), printers, etc. For example, an ISA device may be the display controller 340 shown in FIG. 3.

The mass storage device 472 stores archive information such as code (e.g., token processing), programs, files, data, applications, and operating systems. The mass storage device 472 may include compact disk (CD) ROM 475, floppy diskettes 476, and hard drive 477, and any other magnetic or optic storage devices. The mass storage device 472 provides a mechanism to read machine-readable media. When implemented in software, the elements of the present invention are the code segments to perform the necessary tasks. The program or code segments can be stored in a processor readable medium or transmitted by a computer data signal embodied in a carrier wave, or a signal modulated by a carrier, over a transmission medium. The "processor readable medium" may include any medium that can store or transfer information. Examples of the processor readable medium include an electronic circuit, a semiconductor memory device, a ROM, a flash memory, an erasable ROM (EROM), a floppy diskette, a compact disk CD-ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc.

I/O ports 474 may include any I/O devices to perform I/O functions. Examples of I/O devices include controller for input devices (e.g., keyboard, mouse, trackball, pointing device), media card (e.g., audio, video, graphics), network card, and any other peripheral controllers.

Figure 5A:
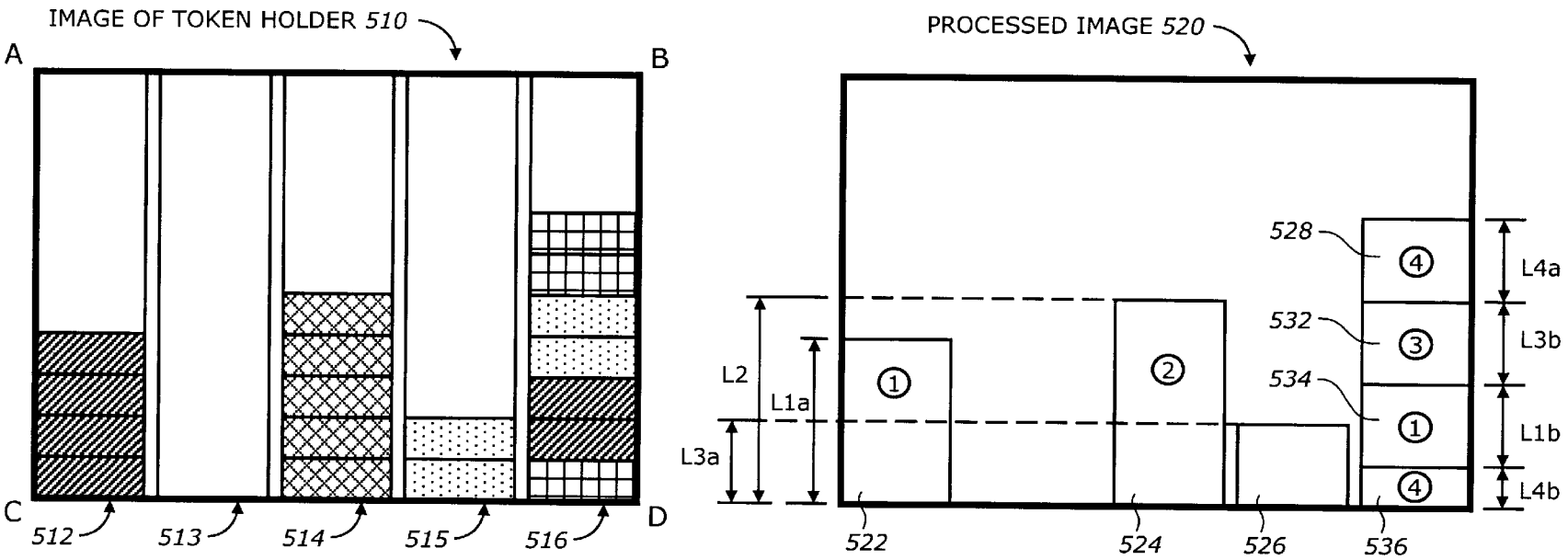
FIG. 5A is a diagram illustrating a token counting technique using image analysis according to one embodiment of the invention.

FIG. 5A is a diagram illustrating a token counting technique using image analysis according to one embodiment of the invention. The token counting technique obtains an image 510 of the token holder 120 (FIG. 1) as produced by the sensor 210 (FIG. 2) and generates a processed image 520. The image 510 and the processed image 520 are for illustrative purposes only.

The image 510 of the token holder has five columns or stacks of tokens 512, 513, 514, 515, and 516. The image 510 has four corner points A, B, C, and D. The tokens may be mixed in the same column. There are four types of tokens. Column 512 has four tokens of type 1. Column 513 is empty, containing no tokens. Column 514 has five tokens of type 2. Column 515 has two tokens of type 3. Column 516 has two tokens of type 1, two tokens of type 3, and three tokens of type 4.

The processed image 520 is the result of the processing of the image 510. The processed image 520 has seven regions 522, 524, 526, 528, 532, 534, and 536. The regions 522, 524, 526, 528, 532, 534, and 536 have lengths L1*a*, L2, L3*a*, L4*a*, L3*b*, L1*b*, and L4*b*, respectively. Regions having the same or similar (within some tolerance) identifying feature are merged together so that the corresponding counting feature (e.g., total length) can be computed by combining the individual counting feature (e.g., summing the individual lengths). The regions 522 and 534 have the same identifying feature, so they are merged together to provide length L1=L1*a*+L1*b*. The regions 526 and 532 have the same identifying feature, so they are merged together to provide length L3=L3*a*+L3*b*. Regions 528 and 536 have the same identifying feature, so they are merged together to provide length L4=L4*a*+L4*b*.

The token count for each type of token is equal to the quotient of the division of the counting feature by the corresponding predetermined counting unit. For example, the predetermined counting unit for the length counting feature is the thickness of the token. In case all tokens have the same counting unit, this counting unit is used for all the types. Let U1, U2, U3, and U4 are the predetermined counting units for token types 1, 2, 3, and 4, respectively. The token counts C1, C2, C3, and C4 for the token types 1, 2, 3, and 4, respectively, are:

C1=L1/U1

C2=L2/U2

C3=L3/U3

C4=L4/U4

Figure 5B:
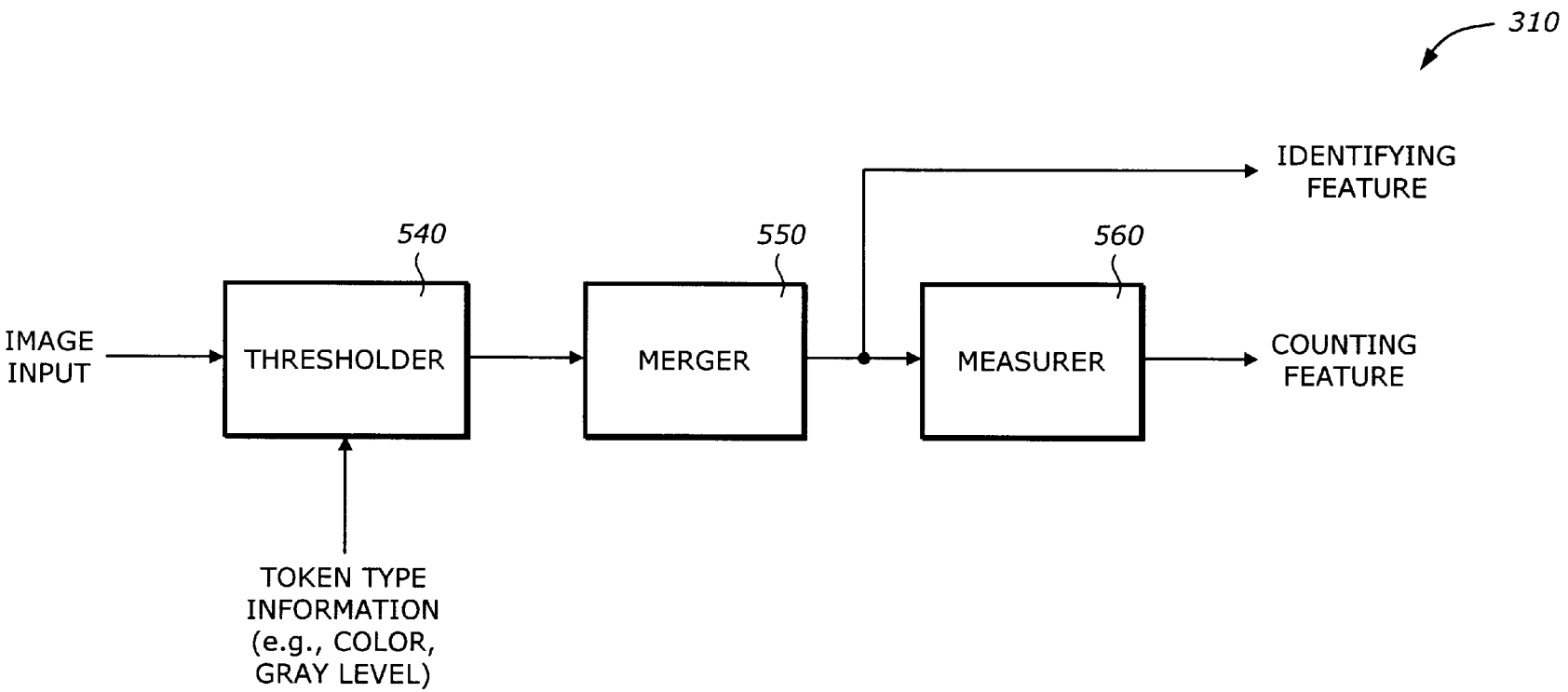
FIG. 5B is a diagram illustrating the image analyzer shown in FIG. 3 according to one embodiment of the invention.

FIG. 5B is a diagram illustrating the image analyzer 310 shown in FIG. 3 according to one embodiment of the invention. The image analyzer 310 includes a thresholder 540, a merger 550, and a measurer 560.

The thresholder 540 receives the image input as provided by the sensor. The thresholder 540 performs the preliminary image analysis by reducing the image to simple regions. Since each token has some characteristic that is distinct from one another, the thresholder 540 separate the image into regions corresponding to the token types. For example, the distinct characteristic may be color, grey level, etc. If the sensor can provide color information (e.g., color video camera), the color can be used to threshold the image. The thresholder 540 essentially replaces the pixel of the image with some predetermined value when that pixel falls within some range of threshold. The objective of the thresholder 540 is to convert the input image into well-defined regions having distinct values or codes. If the sensor has a magnetic reader and the tokens have magnetic data, the sensor can provide the threshold information by reading the magnetic data.

The merger 550 combines similar thresholded regions from the thresholder 540 into a single region. For example, the regions 522 and 534 (shown in FIG. 5A) are combined together because they have the same or similar grey level or color. When regions are combined, their identifying feature is generated. This identifying feature may be a number that codes the token type, the token valuation, the color code, or the grey level code.

The measurer 560 measures the counting feature of the merged regions. The counting feature may be size, length, or any feature that can be used to count the tokens. For example, if the length is used, then the counting feature may be the total number of pixels that correspond to the vertical length of the merged regions. Whatever the counting feature is used, the predetermined counting unit preferably has the same dimension. The measurer 560 generates the counting feature for the corresponding identifying feature.

Figure 5C:
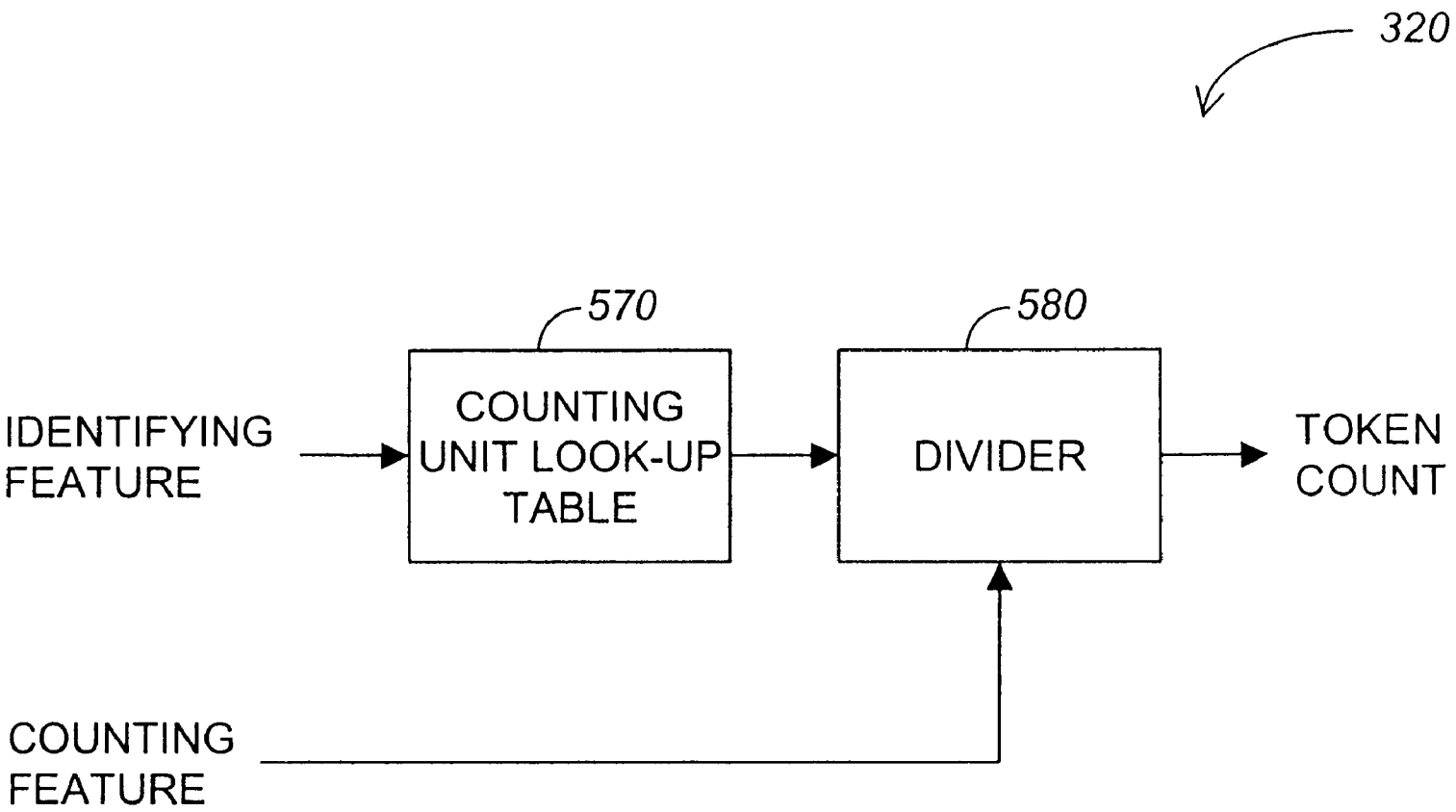
FIG. 5C is a diagram illustrating a counter shown in FIG. 3 according to one embodiment of the invention.

FIG. 5C is a diagram illustrating counter 320 shown in FIG. 3 according to one embodiment of the invention. The counter 320 includes a counting unit look up table (LUT) 570 and a divider 580.

The counting unit LUT 570 stores the predetermined counting units corresponding to the token types. In most cases, all tokens have the same counting unit. For example, in most casinos, all tokens have the same thickness. However, depending on the counting feature used, the corresponding counting units may be different. The counting unit LUT 570 receives the identifying feature from the image analyzer 310 and provides the corresponding counting unit.

The divider 580 receives the counting feature for the identifying feature whose counting unit is being provided by the counting unit LUT 570. The divider 580 divides the counting feature by the corresponding counting unit. The result of the division is the total count of the tokens for the underlying identifying feature. This total count is then recorded and transmitted to the central station for record keeping. The total count can also be displayed on the display so that the dealer can keep track of the amount of tokens in the token holder.

Figure 6A:
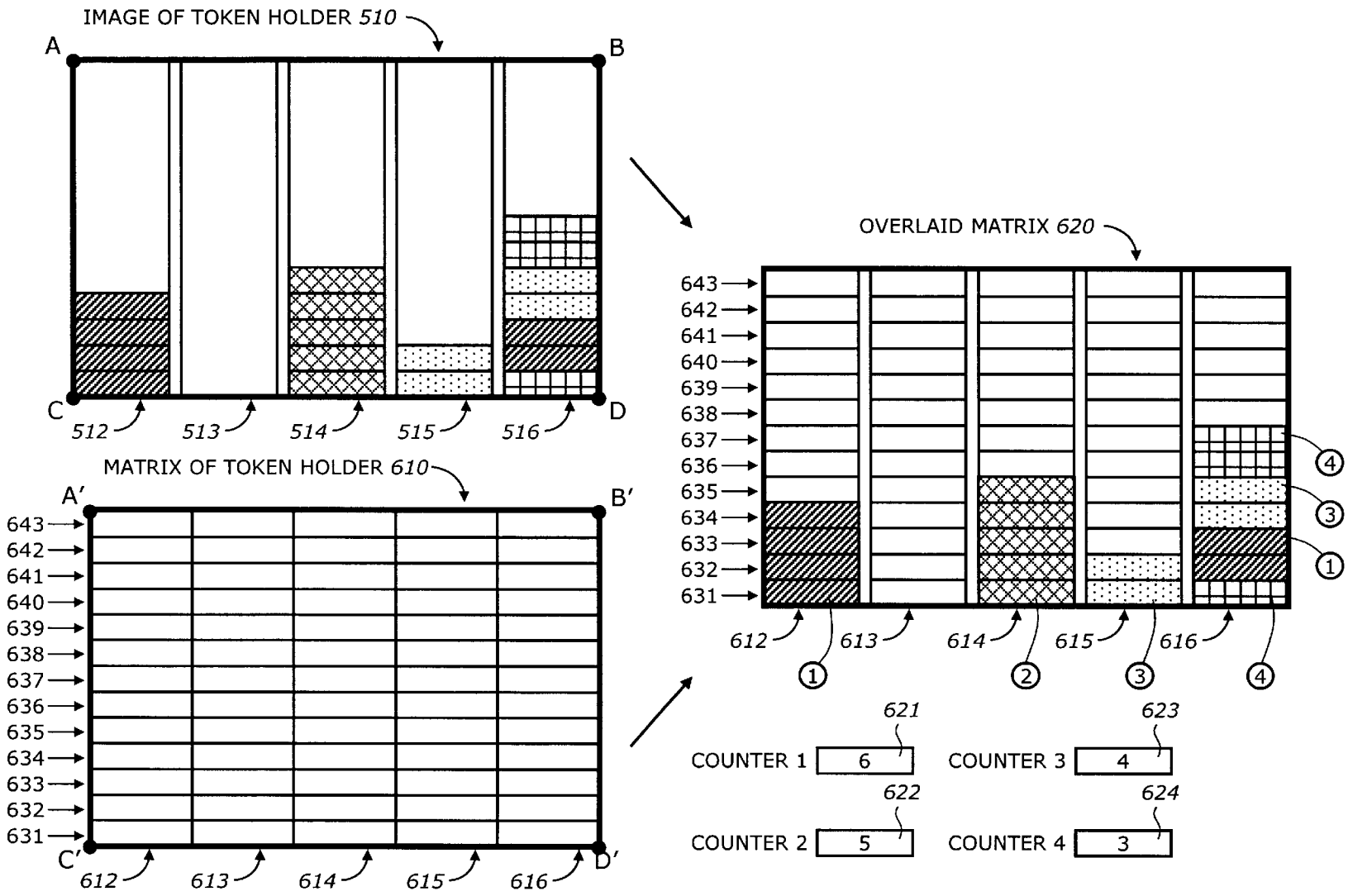
FIG. 6A is a diagram illustrating a token counting technique using matrix matching according to one embodiment of the invention.

FIG. 6A is a diagram illustrating a token counting technique using matrix matching according to one embodiment of the invention. The matrix matching uses the image 510 of the token holder ands a matrix 610, and generates an overlaid matrix 620.

The image 510 is provided by the sensor as discussed above with references to FIG. 5A. The matrix 610 is created to represent the layout of the token holder. The matrix 610, in this example, has five columns 612, 613, 614, 615, and 616, corresponding to the token columns or stacks 512, 513, 514, 515, and 516, respectively. The matrix 610, in this example, has thirteen rows 631, 632, 633, 634, 635, 636, 637, 638, 639, 640, 641, 642, and 643. Each cell in the matrix 610 is identified by the row coordinate and column coordinate. The matrix 610 has four corners A', B', C', and D'.

The image 510 is then overlaid onto the matrix 610. The overlaying is facilitated by positioning the four corners A, B, C, D to coincide with the four corners A', B', C', and D', respectively. The corners of the image 510 can be detected using corner detection techniques as well known in image analysis. Alternatively, landmark points can be used to mark the four corners A, B, C, and D, to facilitate the corner detection. The image 510 is scaled with appropriate scaling factor such that the four corner points A, B, C, and D are matched with the corners A', B', C', and D', respectively, of the matrix 610. The result of the overlaying is the overlaid matrix 620.

After overlaying, the tokens are positioned within the cells of the matrix 610. A cell in the overlaid matrix 620 is either filled or occupied or emptied. An empty cell contains no token. An occupied cell contains a token. To identify the token type, the image characteristic of the occupied cell is compared with some predetermined value in a look-up table or a database. The image characteristic is the identifying feature and may be color, grey level, or any other characterizing feature.

To count the number of tokens, the matrix 620 is examined on a cell by cell basis. At each cell, a determination is made by comparing the identifying feature of the cell with the look-up table or database and the corresponding counter is incremented. In the example shown in FIG. 6A, there are four token types, and there are four counters 621, 622, 623, and 624, corresponding to token types 1, 2, 3, and 4, respectively. For example, the cell at the row coordinate 631 and the column coordinate 612 has an identifying feature of the token type 1. Therefore, the counter 1 621 is incremented by 1. Then the next cell at row coordinate 632 and column coordinate 612 is examined. This cell also has the image characteristic or identifying feature of token type 1, so the counter 1 621 is incremented. The process continues for each cell until all cells in all columns are examined and processed. At the end, all four counters 621, 622, 623, and 624 contain the proper number of tokens.

Figure 6B:
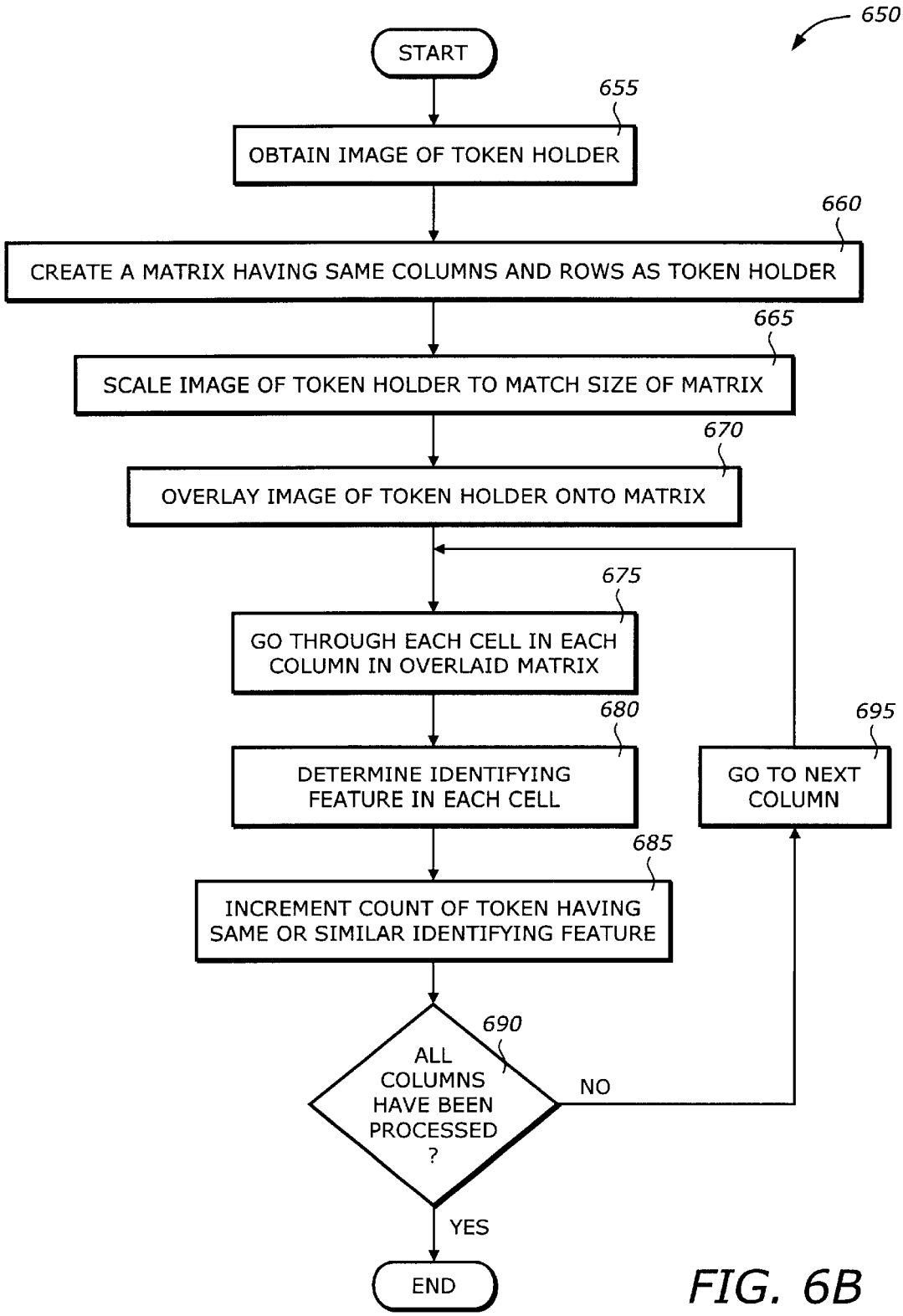
FIG. 6B is a flowchart illustrating the token counting technique using matrix matching according to one embodiment of the invention.

FIG. 6B is a flowchart illustrating a process 650 to count token using matrix matching according to one embodiment of the invention.

Upon START, the process 650 obtains the image of the token counter (Block 655). This image is provided by a sensor such as a scanner, a video camera, or any image-forming sensor. The image may be color or grey level. The image is digitized by the digitizer, or is provided in digital form by the sensor. Then, the process 650 creates a matrix having the same layout as the token holder with the same number of columns and rows (Block 660). Then, the process 650 scales the image of the token holder to match with the size of the matrix (Block 665). The scaling is facilitated by detecting the four corners of the image, measuring the distances between these corner points, and then comparing with the known distances of the matrix. Next, the process 650 overlays the image of the token holder onto the matrix (Block 670) such that the image fits with the matrix.

Then, the process 650 goes through each cell in each column of the overlaid matrix (Block 675). The process 650 examines the image characteristic or identifying feature in each cell (Block 680). This image characteristic may be some value designating the color or gray level corresponding to the token type. The identified image characteristic is used as a pointer to look up the corresponding token type. Next, the process 650 increments the counter corresponding to the identified image characteristic (Block 685).

Next, the process 650 determines if all columns in the overlaid matrix have been processed (Block 690). If not, the process 650 goes to the next column (Block 695) and returns to block 675 to continue examining the cells in the column. Otherwise, all cells have been processed and the process 650 is terminated.

Figure 7:
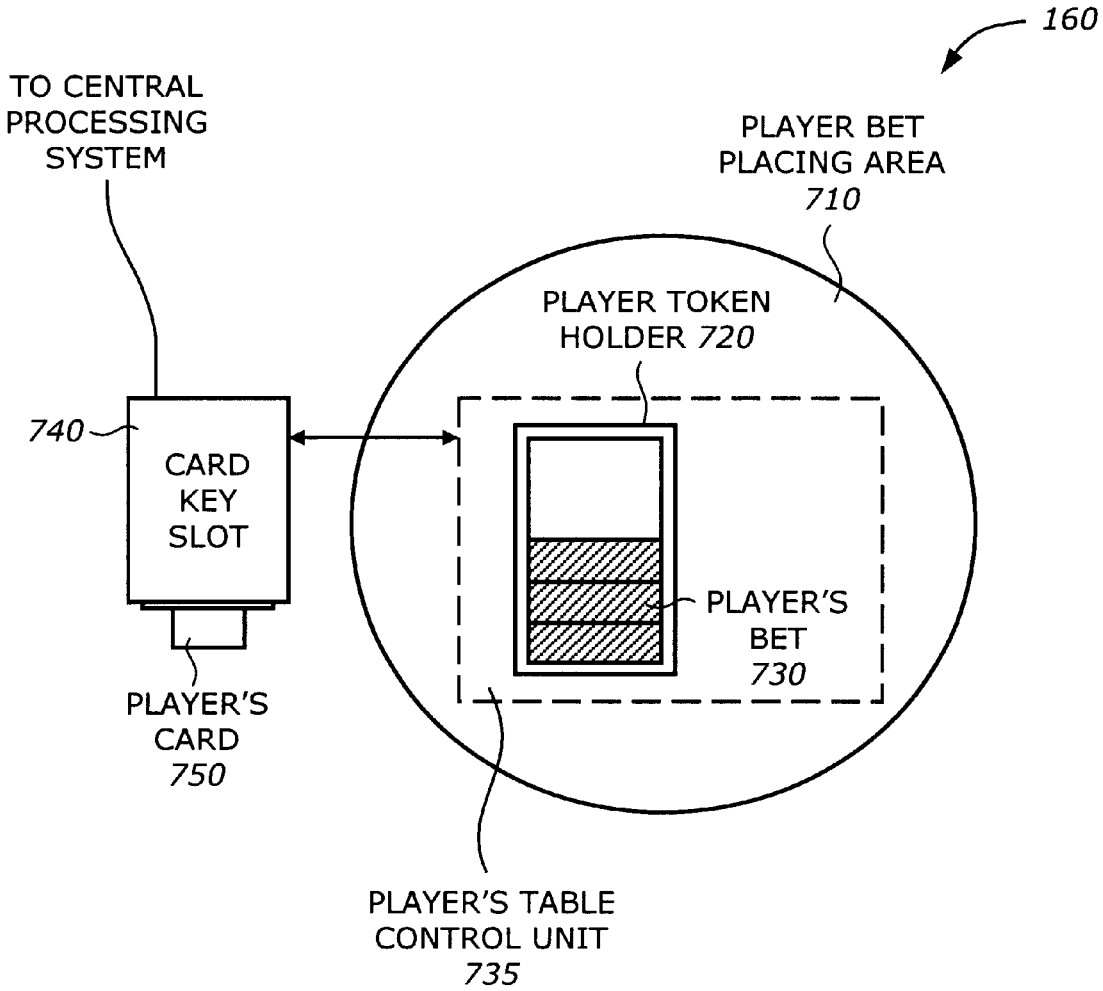
FIG. 7 is a diagram illustrating a player's bet area shown in FIG. 1 according to one embodiment of the invention.

FIG. 7 is a diagram illustrating a player's bet area 160 shown in FIG. 1 according to one embodiment of the invention. The player's bet area 160 includes a player's bet placing area 710, a card key slot 740 and a player's card 750.

The player's bet placing area 710 is the area where the player puts his or her betting tokens. The player's bet placing area 710 includes a player token holder 720 which contains the player's bet 730, and a player's table control unit 735. The player's table control unit 735 includes the token processing unit as described earlier. The player's control unit 735 includes a sensor and circuitry to count the tokens placed by the player in the player token holder 720. A display can be used to show the amount of bet.

The player's card 750 includes information about the player so that the casino can keep track of the play of the player. The information is embedded on the card using magnetic medium or smart card which contains electromagnetic storage. The card key slot 740 includes a card reader to read the information on the player's card and to write or update the play of the player. The bet of the player as determined automatically by the player's table control unit is fed to the card key slot 740 to update the player's play. Alternatively, this bet information can be entered manually by the player or the dealer and confirmed by the dealer. In addition, the outcome of each play session is also recorded, such as the amount of wins or losses. The play of the player may include the amount of bet, the time between placing bets, the average bet amount in some time unit, or any other information that the casino wants to keep track of. The information is then routed back to the central station for record keeping. By keeping track of the player's play automatically, the casino is able to determine potential good customers for marketing and promotional purposes.

While this invention has been described with reference to illustrative embodiments, this description is not intended to be construed in a limiting sense. Various modifications of the illustrative embodiments, as well as other embodiments of the invention, which are apparent to persons skilled in the art to which the invention pertains are deemed to lie within the spirit and scope of the invention.

What is claimed is:

1. An apparatus comprising:

a sensor to sense a characteristic embedded in each token of a plurality of tokens in a token holder on a gaming table, the characteristic representing a valuation of each token; and a token processing unit coupled to the sensor to process the sensed characteristic to determine a count of the plurality of tokens.

2. The apparatus of claim 1 wherein the sensor comprises:

an image scanner mounted below the token holder to generate an image of the tokens, the image containing an identifying feature and a counting feature, the identifying feature corresponding to the characteristic of the plurality of tokens.

3. The apparatus of claim 2 wherein the token processing unit comprises:

an image analyzer to analyze the image of the tokens to extract the identifying and counting features; and a counter coupled to the image analyzer to generate the count of the plurality of tokens according to the extracted identifying and counting features.

4. The apparatus of claim 3 wherein the counter divides the counting feature of the plurality of tokens having similar identifying feature by a corresponding predetermined counting unit to generate a quotient, the quotient corresponding to the count of the plurality of tokens.

5. The apparatus of claim 4 wherein the identifying feature is one of a size, a color, and an image density.

6. The apparatus of claim 5 wherein the counting feature is one of an aggregate thickness of the plurality of tokens and an aggregate size of the plurality of tokens.

7. The apparatus of claim 2 wherein the token processing unit further comprises:

a recorder to record the count in a storage.

8. The apparatus of claim 7 wherein the token processing unit further comprises:

a display controller to display the count on a display.

9. The apparatus of claim 8 further comprises:

a network interface coupled to the token processing unit and a network to allow exchange information between the token processing unit with a remote server, the information including the recorded count.

10. The apparatus of claim 9 wherein the remote server sends a command to the token processing unit, the command controlling exchanging the information.

11. A method comprising:

sensing a characteristic embedded in each token of a plurality of tokens in a token holder on a gaming table, the characteristic representing a valuation of each token; and processing the sensed characteristic to determine a count of the plurality of tokens based on the sensed characteristic.

12. The method of claim 11 wherein sensing comprises:

generating an image of the tokens, the image containing an identifying feature and a counting feature, the identifying feature corresponding to the characteristic of the plurality of tokens.

13. The method of claim 12 wherein processing comprises:

analyzing the image of the tokens to extract the identifying and counting features; and generating the count of the plurality of tokens according to the extracted identifying and counting features.

14. The method of claim 13 wherein generating the count comprises dividing the counting feature of the plurality of tokens having similar identifying feature by a corresponding predetermined counting unit to generate a quotient, the quotient corresponding to the count of the plurality of tokens.

15. The method of claim 14 wherein the identifying feature is one of a size, a color, and an image density.

16. The method of claim 15 wherein the counting feature is one of an aggregate thickness of the plurality of tokens and an aggregate size of the plurality of tokens.

17. The method of claim 13 wherein processing further comprises:

recording the count in a storage.

18. The method of claim 17 wherein processing further comprises:

displaying the count on a display.

19. The method of claim 18 further comprises:

exchanging information between the token processing unit with a remote server via a network interface, the information including the recorded count.

20. The method of claim 19 wherein exchanging information comprises sending a command from the server to the token processing unit, the command controlling exchanging the information.

21. A system comprising:

a gaming table;

a token holder located on the gaming table to hold a plurality of tokens; and a table control unit comprising:

a sensor to sense a characteristic embedded in each token of a plurality of tokens in a token holder on a gaming table, the characteristic representing a valuation of each token, and a token processing unit coupled to the sensor to process the sensed characteristic to determine a count of the plurality of tokens.

22. The system of claim 21 wherein the sensor comprises:

an image scanner mounted below the token holder to generate an image of the tokens, the image containing an identifying feature and a counting feature, the identifying feature corresponding to the characteristic of the plurality of tokens.

23. The system of claim 22 wherein the token processing unit comprises:

an image analyzer to analyze the image of the tokens to extract the identifying and counting features; and a counter coupled to the image analyzer to generate the count of the plurality of tokens according to the extracted identifying and counting features.

24. The system of claim 23 wherein the counter divides the counting feature of the plurality of tokens having similar identifying feature by a corresponding predetermined counting unit to generate a quotient, the quotient corresponding to the count of the plurality of tokens.

25. The system of claim 24 wherein the identifying feature is one of a size, a color, and an image density.

26. The system of claim 25 wherein the counting feature is one of an aggregate thickness of the plurality of tokens and an aggregate size of the plurality of tokens.

27. The system of claim 22 wherein the token processing unit further comprises:

a recorder to record the count in a storage.

28.The system of claim 27 wherein the token processing unit further comprises:

a display controller to display the count on a display.

29. The system of claim 28 wherein the table control unit further comprises:

a network interface coupled to the token processing unit and a network to allow exchange information between the token processing unit with a remote server, the information including the recorded count.

30. The system of claim 9 wherein the remote server sends a command to the token processing unit, the command controlling exchanging the information.

31. The apparatus of claim 1 wherein the characteristic is one of size, shape, color, and magnetic data.

32. The apparatus of claim 31 wherein the sensor comprises:

a magnetic reader to read the magnetic data embedded in each token.

33. The method of claim 11 wherein the characteristic is one of size, shape, color, and magnetic data.

34. The method of claim 33 wherein sensing comprises:

reading the magnetic data embedded in each token by a magnetic reader.

35. The system of claim 21 wherein the characteristic is one of size, shape, color, and magnetic data.

36. The system of claim 35 wherein the sensor comprises:

a magnetic reader to read the magnetic data embedded in each token.

* * * * *

UNITED STATES PATENT AND TRADEMARK OFFICE

CERTIFICATE OF CORRECTION

PATENT NO. : 6,626,750 B2
DATED : September 30, 2003
INVENTOR(S) : Momeny

It is certified that error appears in the above-identified patent and that said Letters Patent is hereby corrected as shown below:

Title page,
Item [76], Inventor, please delete "Momemy" and insert -- Momeny --.
Item [56], References Cited, U.S. PATENT DOCUMENTS, reference "6,425,817", please delete "Momemy" and insert -- Momeny --.

Signed and Sealed this

Second Day of March, 2004

JON W. DUDAS
*Acting Director of the United States Patent and Trademark Office*